US012344356B1

(12) United States Patent
Souder

(10) Patent No.: US 12,344,356 B1
(45) Date of Patent: Jul. 1, 2025

(54) HANDBOARD FOR BODYSURFING

(71) Applicant: Steven B. Souder, Naples, FL (US)

(72) Inventor: Steven B. Souder, Naples, FL (US)

( * ) Notice: Subject to any disclaimer, the term of this patent is extended or adjusted under 35 U.S.C. 154(b) by 533 days.

(21) Appl. No.: 17/869,083

(22) Filed: Jul. 20, 2022

(51) Int. Cl.

| | |
|---|---|
| ***B63B 32/22*** | (2020.01) |
| ***A63B 31/10*** | (2006.01) |
| ***B63B 32/20*** | (2020.01) |
| ***B63B 32/50*** | (2020.01) |
| ***B63B 32/60*** | (2020.01) |
| ***B63B 32/73*** | (2020.01) |

(52) U.S. Cl.
CPC ..... *B63B 32/22* (2020.02); *A63B 31/10* (2013.01); *B63B 32/20* (2020.02); *B63B 32/50* (2020.02); *B63B 32/60* (2020.02); *B63B 32/73* (2020.02)

(58) Field of Classification Search
CPC ..... B63B 32/00; B63B 32/20; B63B 32/22; B63B 32/50; B63B 32/60; B63B 32/73; A63B 31/10; A63B 31/12; A63B 69/14
USPC .... 441/56–59; D21/769, 770, 803, 804, 807
See application file for complete search history.

(56) References Cited

U.S. PATENT DOCUMENTS

| | | | | |
|---|---|---|---|---|
| 183,045 | A | 10/1876 | Dunlop | |
| D263,860 | S | 4/1982 | Cole | |
| 5,167,551 | A | 12/1992 | Davis | |
| 5,318,467 | A | 6/1994 | Mcintyre | |
| D392,710 | S * | 3/1998 | del Paso | D21/769 |
| D399,905 | S * | 10/1998 | VanderMolen | D21/806 |
| 6,257,944 | B1 * | 7/2001 | Herrod | F41B 9/004 441/130 |
| 6,544,089 | B2 | 4/2003 | Zapatero | |
| 7,125,299 | B1 | 10/2006 | Ross, Jr. | |
| D590,470 | S * | 4/2009 | Mun | D21/769 |
| D638,897 | S * | 5/2011 | Parsia | D21/769 |
| 8,105,125 | B2 | 1/2012 | Sick | |
| D683,414 | S | 5/2013 | Bell | |
| 8,864,539 | B1 | 10/2014 | Watts | |
| 8,882,553 | B2 | 11/2014 | Hanrahan | |
| 9,656,295 | B2 | 5/2017 | Watts | |
| 9,750,981 | B2 | 9/2017 | Davis | |
| D820,375 | S | 6/2018 | Warren | |
| D826,357 | S | 8/2018 | Warren | |
| D826,358 | S | 8/2018 | Warren | |
| D928,267 | S * | 8/2021 | Zhang | D29/124 |
| 2010/0273372 | A1 * | 10/2010 | Parsia | B63B 34/54 441/74 |

OTHER PUBLICATIONS

"Hand Job Mig Board" https://www.instagram.com/p/CHqNtxCpcLx/?hl=en.
"SLYDE Handboard" https://www.slydehandboards.com/.
"SPOON Handboard" https://www.amazon.com/Salt-Creek-Palmboards-The-Spoon/dp/B00M2AIW1U.

* cited by examiner

*Primary Examiner* — Ajay Vasudeva
(74) *Attorney, Agent, or Firm* — Bryan L. Loeffler, Esq.; LOEFFLER IP GROUP, P.A.

(57) ABSTRACT

A handboard (1) that provides an improved configuration of hand holds and forearm holds to provide users with easier hold and control of the handboard while bodysurfing.

13 Claims, 3 Drawing Sheets

HANDBOARD FOR BODYSURFING

FIELD OF THE INVENTION

This invention relates to the sport of bodysurfing and more particularly, a handboard that provides improved grips and an improved ability to steer while bodysurfing.

BACKGROUND OF THE INVENTION

Bodysurfing is the sport of riding a wave without the assistance of a buoyant device, such as a surfboard or bodyboard, to stay afloat. When body surfing, the individual is hydroplaning or skimming across the face of a wave using his or her body. This may be performed in a superman-style position with both arms and hands fully extended over the head; or in a reaching-style position with arm and hand fully extended over the head with the opposite arm and hand kept at the side of the body. Bodysurfers may wear swim fins to aid in propulsion and help the bodysurfer catch, ride, and kick out of waves.

Some bodysurfers may also use a handboard, which is also known as a handplane. Conventional handboards are used by bodysurfers to enhance their speed, lift, and control while riding a wave. However, conventional handboards are limited in their use as they are mainly designed for use with one hand and not two. In addition, many conventional handboards have straps that attach to a bodysurfer's leading hand, thereby inhibiting the use of other bodysurfing positions and the individual's ability to swim with the handboard.

Therefore, a need exists for a handboard that provides an improved configuration of hand holds and forearm holds that make the handboard usable in multiple bodysurfing positions and provides added control while bodysurfing.

SUMMARY OF THE INVENTION

The primary object of the present invention is to provide a handboard that provides an improved configuration of hand holds and forearm holds that make the handboard easier to hold and control while bodysurfing.

The present invention solves the above and other objects by providing a handboard having a body with a top surface, bottom surface, right side edge, left side edge, and a rear edge. The right side edge and left side edge meet at an apex located at a front tip of the body to create a nose section of the board followed by a center section and then an end section. An outline of the body is formed by the right-side edge and the left side edge each curving outward from the center axis toward the tail section. The right side edge and the left side edge each then turn back inward toward the center axis and curve back toward the rear edge to form the tail section of the body.

The top surface of the handboard is preferably convex-shaped and/or rounded over on the right side edge and the left side edge. In contrast, the bottom surface of the body is preferably concave or curves inward to increase the surface area of the bottom surface, thereby providing greater lift to the user.

A handhold cutout is located between the nose section and the center section of the body to provide a grip for one or both hands of the user. The handhold cutout has a back edge that is preferably curved toward the rear edge of the body. The curved shape of the handhold cutout forces the hand or hands of the user into proper position on the hand board to allow for increased control while steering.

Grooved holds are located on the top surface of the body adjacent to the side edges of the center section of the body. A user may rest his or her forearms in the grooved holds and hold the side edges of the body or the hand hold. The added stability provided by the grooved holds increases the ability to maneuver the handboard in the water and, thus, steer.

One or more fins may be located on the bottom surface of the body for added maneuverability, stability, and propulsion through the water. An attachment point for a leash is preferably provided on the tail section of the body to allow a user to secure the handboard to his or her wrist during use.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
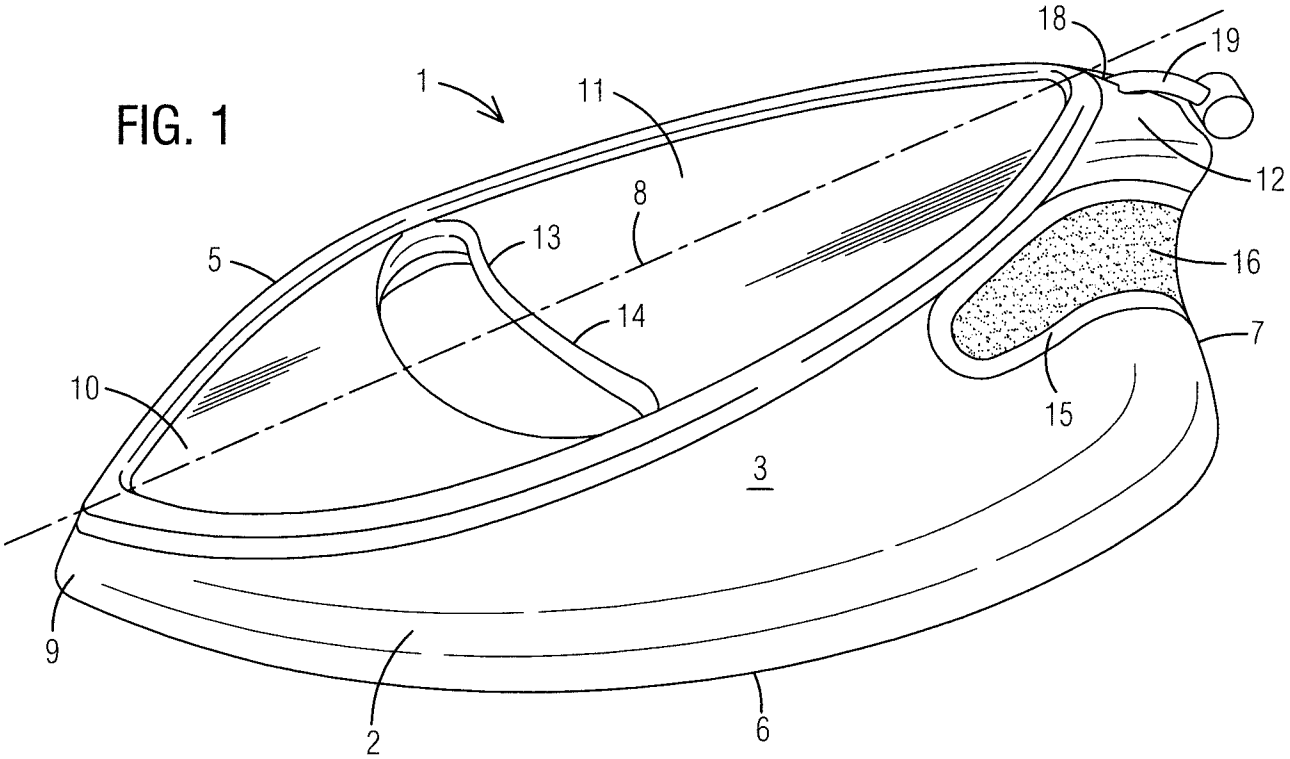
FIG. 1 is a top perspective view of a handboard present invention.
Figure 3:
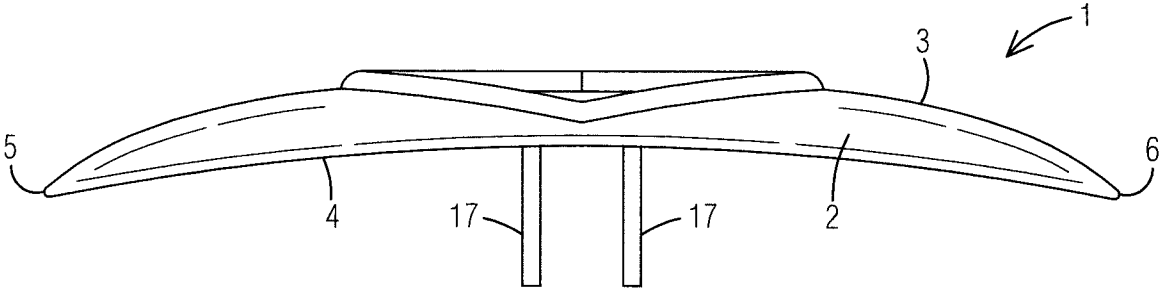
FIG. 3 is a front view of the handboard present invention.
Figure 2:
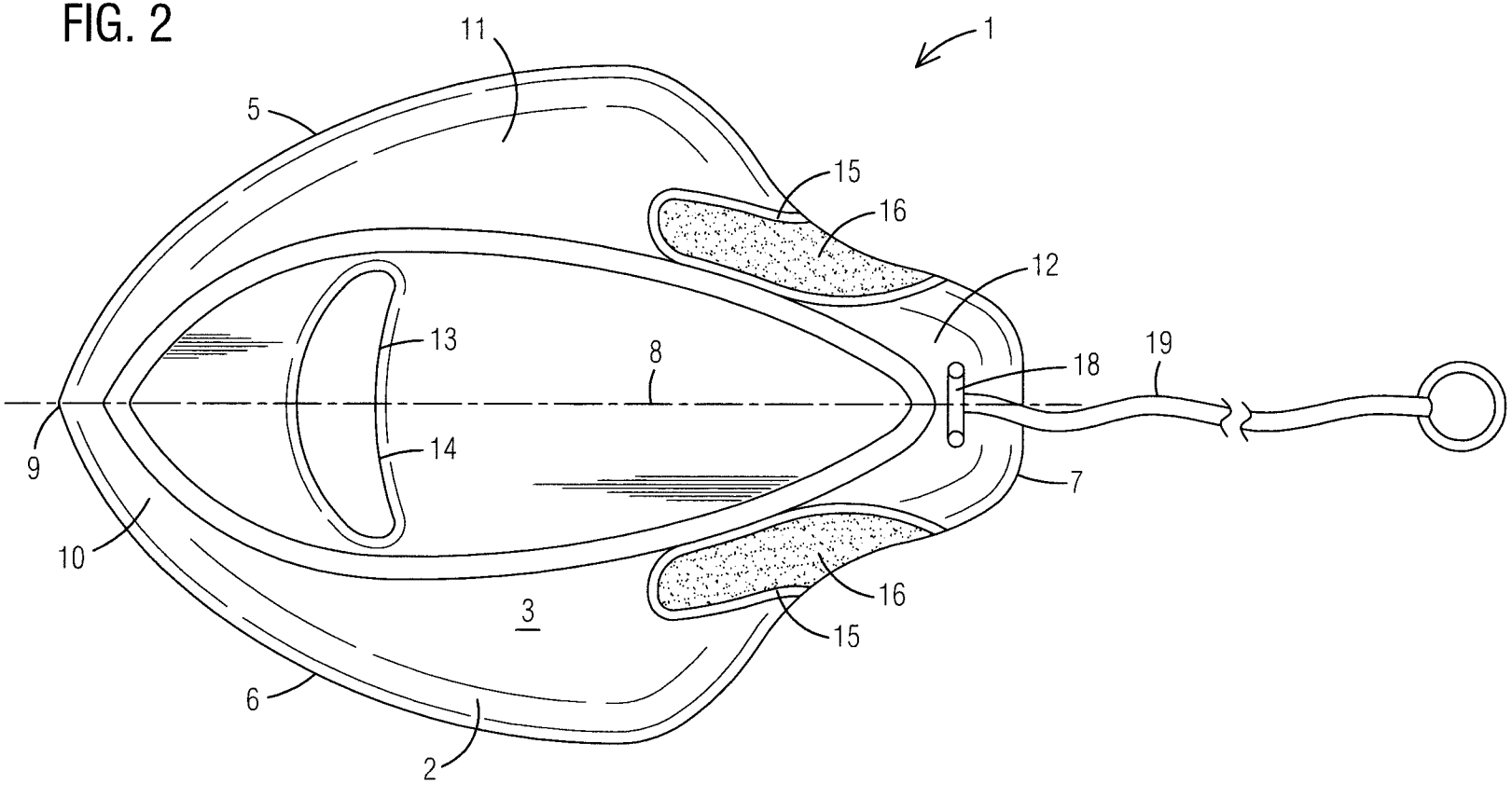
FIG. 2 is a top view of the handboard present invention.
Figure 4:
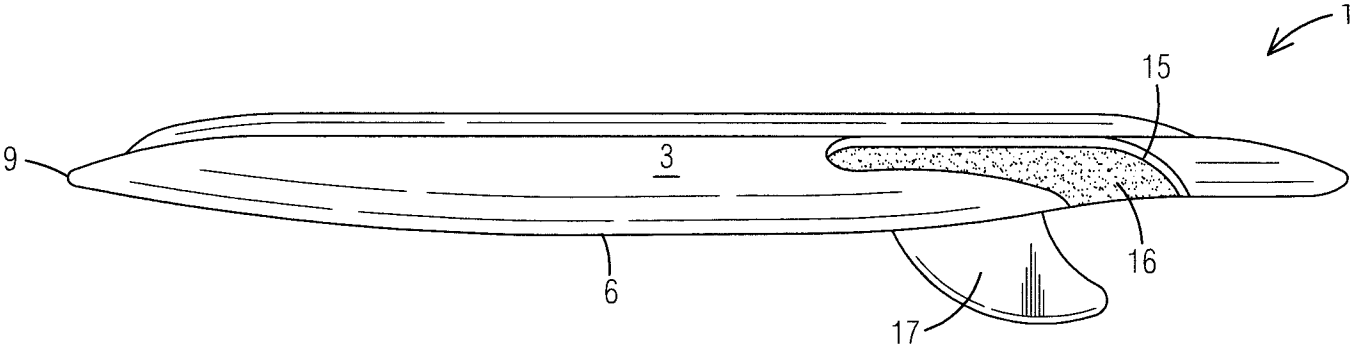
FIG. 4 is a right side view of the handboard present invention.
Figure 5:
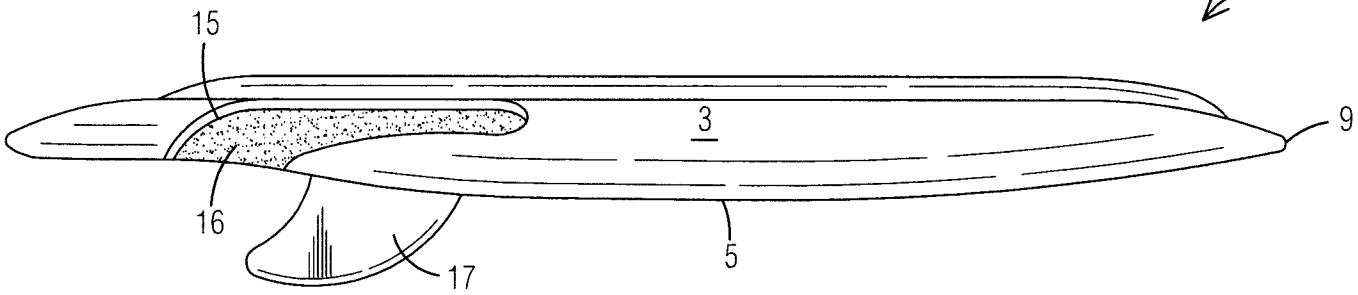
FIG. 5 is a left side view of the handboard present invention.

For purposes of describing the preferred embodiment, the terminology used in reference to the numbered accessories in the drawings is as follows:

1. handboard, generally
2. body
3. top surface
4. bottom surface
5. right side edge
6. left side edge
7. rear edge
8. center axis
9. apex
10. nose section
11. center section
12. tail section
13. handhold cutout
14. back edge
15. side grooved hold
16. non-slip surface
17. fin
18. attachment point
19. leash With general reference to FIGS. 1-5, a handboard 1 of the present invention is illustrated. The handboard 1 comprises a body 2 with a top surface 3, a bottom surface 4, a right side edge 5, a left side edge 6, a rear edge 7, and a center axis 8. The right side edge 5 and left side edge 6 meet to form an apex 9 and then each extend rearwardly to outline a nose section 10, a center section 11, and a tail section 12 of the body 2. The right side edge 5 and the left side edge 6 each curve outward from the apex 9 and the center axis 8 to form the nose section 10 and the center section 11 before each curve back inward toward the center axis 8 to form the tail section 12.

The top surface 3 of the body 2 is preferably convex-shaped and/or rounded over on the right side edge 5 and the left side edge 6. In contrast, the bottom surface 4 of the body 2 is preferably concave or curved inward to increase the surface area of the bottom surface 4, which makes it easier to grab a wave and increases lift and control.

A handhold cutout 13 is preferably located between the nose section 10 and the center section 11 of the body 2 to provide a handgrip 13 for one or both hands of the user. The handhold cutout 13 comprises a back edge 14 that is preferably curved toward the tail section 13 of the body 2. The curved shape of the handhold cutout 13 forces the hand or hands and wrists of the user into proper position on the handboard 1 to allow for increased control while steering.

Side grooved holds 15 are located on the top surface 3 of the body 2 adjacent to each side edge 5 and 6 and on opposing sides of the body 2. A user may rest his or her forearms in the side grooved holds 15 and hold the side edge 5 and 6 of the body 2 or grasp the hand hold cutout 13. As illustrated herein, the side grooved holds 15 are curved grooves. A user may cradle his or her forearms therein to increase control and maneuverability while using the handboard 1 in a superman-style position with both arms extended over the head. A non-slip surfaces 16 are preferably located within the grooved holds 15 to provide better grip between the body 2 and a user.

One or more fins 17 may be located on the bottom surface 8 of the body 2 for added maneuverability, stability, and propulsion through the water. An attachment point 18 for a leash 19 is preferably provided on the tail section 12 of the body 2 to allow a user to secure the handboard 1 to his or her wrist during use so it will not be lost during use.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A handboard for use while bodysurfing, said handboard comprising:

a body having a top surface, a bottom surface, a right side edge, a left side edge, a rear edge, a center axis, and an apex;

wherein said right side edge and said left side edge each curve outward from the apex and the center axis to form a nose section and a center section before said right side edge and said left side edge each curve back inward toward the center axis to form a tail section;

said top surface of the body having a convex surface;

said bottom surface of the body having a concave surface;

a handhold cutout located between the nose section and the center section of the body to provide a handgrip for a user; and said body having grooved holds located on said top surface of the body and each being adjacent to the right side edge and the left side edge, respectively.

2. The handboard of claim 1 wherein:

said handhold cutout having a back edge that is curved toward said tail section of the body.

3. The handboard of claim 1 further comprising:

non-slip surfaces located within the grooved holds.

4. The handboard of claim 1 further comprising:

at least one fin located on the bottom surface of the body.

5. The handboard of claim 1 further comprising:

an attachment point for a leash located on the tail section of the body.

6. A handboard for use while bodysurfing, said handboard comprising:

a body having a top surface, a bottom surface, a right side edge, a left side edge, a rear edge, a center axis, and an apex;

wherein said right side edge and said left side edge each curve outward from the apex and the center axis to form a nose section and a center section before said right side edge and said left side edge each curve back inward toward the center axis to form a tail section;

said top surface of the body having a convex surface;

said bottom surface of the body having a concave surface;

a handhold cutout located between the nose section and the center section of the body to provide a handgrip for a user;

said body having grooved holds located on said top surface of the body and each being adjacent to the right side edge and the left side edge, respectively; and said handhold cutout having a back edge that is curved toward said tail section of the body.

7. The handboard of claim 6 further comprising:

non-slip surfaces located within the grooved holds.

8. The handboard of claim 6 further comprising:

at least one fin located on the bottom surface of the body.

9. The handboard of claim 6 further comprising:

an attachment point for a leash located on the tail section of the body.

10. A handboard for use while bodysurfing, said handboard comprising:

a body having a top surface, a bottom surface, a right side edge, a left side edge, a rear edge, a center axis, and an apex;

wherein said right side edge and said left side edge each curve outward from the apex and the center axis to form a nose section and a center section before said right side edge and said left side edge each curve back inward toward the center axis to form a tail section;

said top surface of the body having a convex surface;

said bottom surface of the body having a concave surface;

a handhold cutout located between the nose section and the center section of the body to provide a handgrip for a user;

said body having grooved holds located on said top surface of the body and each being adjacent to the right side edge and the left side edge, respectively; and non-slip surfaces located within the grooved holds.

11. The handboard of claim 10 wherein:

said handhold cutout having a back edge that is curved toward said tail section of the body.

12. The handboard of claim 10 further comprising:

at least one fin located on the bottom surface of the body.

13. The handboard of claim 10 further comprising:

an attachment point for a leash located on the tail section of the body.

* * * * *